United States Patent [19]

Erixson

[11] 3,981,754

[45] Sept. 21, 1976

[54] METHOD FOR HEATING SHEET METAL

[75] Inventor: John Erixson, Vasteras, Sweden

[73] Assignee: Granges Engineering AB, Vasteras, Sweden

[22] Filed: July 3, 1975

[21] Appl. No.: 593,161

Related U.S. Application Data

[63] Continuation-in-part of Ser. No. 309,594, Nov. 24, 1972, abandoned.

[30] Foreign Application Priority Data

Nov. 30, 1971 Sweden ..... 15294/71

[52] U.S. Cl. ..... 148/155; 148/13; 148/156; 432/5; 432/11

[51] Int. Cl.[2] ..... C21D 9/46

[58] Field of Search ..... 148/155, 156, 13, 3, 148/134, 153; 432/2, 5, 6, 11

[56] References Cited

UNITED STATES PATENTS

| | | | |
|---|---|---|---|
| 3,215,420 | 11/1965 | Bottenhorn | 148/155 |
| 3,291,954 | 12/1966 | Scheffler | 148/155 |
| 3,655,460 | 4/1972 | Hayden et al. | 148/156 |

*Primary Examiner*—R. Dean

*Attorney, Agent, or Firm*—Haseltine, Lake & Waters

[57] ABSTRACT

A method for avoiding irregularities in the surface of heavy steel sheet when heating or heat-treating such sheet by exposing both flat sides thereof to heat in a furnace. The sheet is transported endwise in the furnace in a substantially horizontal direction in a plane inclined with respect to the vertical and transverse to the furnace by a sheet supporting device comprising a roller path engaging one flat side of the sheet to sustain only part of the weight of the sheet and a further supporting means engaging the lower edge of the sheet. The angle of inclination of the steel sheet is selected so that the pressure exerted by the sheet perpendicularly against the rollers of the roller path is at most equal to the pressure that would be exerted by a 12 to 15 mm thick steel sheet via one flat side thereof against a similar, although horizontally arranged roller path, thereby avoiding the agglomeration of scale on said one flat side of the inclined sheet and the rollers of the roller path. The remaining portion of the weight of the inclined steel sheet is taken up by said further supporting means.

4 Claims, 3 Drawing Figures

METHOD FOR HEATING SHEET METAL

This application is a continuation-in-part of copending application Ser. No. 309,594 filed Nov. 24, 1972, and now abandoned.

The present invention is concerned with the heating or heat-treatment of steel sheet, particularly sheet steel having a thickness exceeding 12 mm, in a furnace in which a roller path is arranged to engage one flat side of the steel sheet, and relates to a method for counteracting or avoiding the agglomeration of foreign material such as scale on the rollers of the roller path, such agglomerations or scale heaps being liable to cause irregularities in the surface of the steel sheet and possibly also to adhere thereto.

When heating and heat-treating sheet metal, there are normally used roller hearth furnaces having horizontal support rollers which convey the steel sheets through the furnace with the sheets resting in a horizontal position on the rollers. Particularly when heating and heat-treating relatively thick steel sheets, for example steel sheets having a thickness exceeding 12–15 mm, the sheets at certain temperatures, for example temperatures in the region of 900°–950°C in the case of steel normalizing processes, are liable to be subjected to so-called pick-up, by which is meant that scale from the steel sheet adheres to the support rollers in the form of small lumps, which are pressed into the steel sheet and mark the same.

These marks or depressions in the surface of the steel sheet among other things render the sheet less resistant to corrosion and therefore cannot often be tolerated, but must be removed by some appropriate method, such as grinding for example. For the purpose of suppressing the formation of scale, and therewith of also avoiding pick-up, there have been used in a number of cases furnaces which are heated indirectly, e.g. furnaces heated by radiation tubes, or electrically heated furnaces, and in some cases the steel sheet has been heated or heat-treated in an atmosphere of a protecting gas. In this connection, the steel sheets have also been sand-blasted prior to being heated, to remove any scale initially present thereon. These latter types of furnaces are, however, expensive to construct and to operate, and have, furthermore, not given a totally satisfactory result.

The object of the present invention is to provide a method with which the problem of pick-up is solved in a novel, simple and economically advantageous manner.

To this end, it is proposed in accordance with the invention a method of counteracting or preventing formation and agglomeration of scale and other foreign material on the roller surfaces of a roller path for supporting one flat side of a heavy steel sheet during heat treatment of said sheet in a furnace, comprising the steps of: transporting the steel sheet endwise in a substantially horizontal direction in said furnace; disposing and supporting said one flat side of the sheet by said roller path in a plane inclined with respect to the vertical and transverse to the furnace, during the entire heat treatment, to sustain only part of the weight of the inclined sheet; supporting the inclined sheet along the lower edge thereof by further sheet-supporting means, substantially at right angles to the roller path, during the entire heat treatment, to sustain the rest of the weight of the inclined sheet; selecting the angle of inclination of the sheet to the vertical so that the actual steel sheet thickness, expressed in millimeters, multiplied by the sine value of said angle of inclination is at most 12 to 15 millimeters to thereby restrict the pressure exerted by the inclined sheet perpendicularly against the rollers of the roller path to a value insufficient to cause the agglomeration of scale on said one flat side of the sheet and said rollers; and applying simultaneously with the described steps a heat treatment to the inclined steel sheet by exposing both said one flat side and the opposite flat side of the sheet between the rollers of the roller path to heat, to shortent the stay time of the sheet in the furnace. By inclining the surfaces supporting the flat side of the steel sheet in accordance with the invention, the specific surface pressure created against the supporting roller surfaces by the steel sheet is reduced in a manner such that scale or other foreign material occurring on the steel sheet supporting surfaces of the roller path is unable to agglomerate in a manner to form lumps, which may be liable to be pressed into the surface of the sheet.

The angle to which the steel sheet supporting surfaces of the roller path are inclined may, to a certain extent, be selected with respect to the desired quality of the surface of the steel sheet. If, for example, a 15 mm thick steel sheet is the thickest sheet which can be heat-treated without pick-up in a particular conventional furnace having a horizontal roller hearth, there is, for the purpose of totally avoiding pick-up with a corresponding heat-treatment process effected in accordance with the invention while using a roller path which although obliquely positioned corresponds in other respects to the roller hearth of said conventional furnace, selected such angle of inclination for the roller path that the thickest sheets for which the furnace is constructed do not create a greater normal pressure against the inclined roller path than the 15 mm thick sheet would exert against the horizontal roller hearth, for example the roller path is inclined to an angle of at most approximately 22° to the vertical plane in a furnace capable of being used with steel sheets up to 40 mm thick, since the sine value of 22° multiplied by 40 mm is equal to 15 mm, and at most approximately 17.5° to the vertical plane in a furnace capable of being used for steel sheets up to 50 mm thick, since the sine value of 17.5° multiplied by 50 mm is equual to 15 mm.

If, however a certain degree of pick-up can be tolerated the angle between the roller path and the vertical plane can be made somewhat larger. It is preferred in accordance with the invention, however, that the steel sheet supporting surfaces or the roller path is inclined to an angle such that no pick-up occurs, since the difference between the angle of inclination where no pick-up takes place and the angle of inclination where troublesome pick-up occurs is normally relatively small.

When practicing the method of the present invention heating means are brought in a known manner to act on both the flat surface located between the rollers of the roller path and the opposite flat surface of the steel sheet. In this way, the steel sheet is quickly heated throughout, thereby enabling its stay time in the furnace to be shortened and causing a reduction in the quantity of scale formed during the heat treatment operation, whereby the conditions with which pick-up can take place are also counteracted.

With the method of the present invention, according to which a significant and normally the largest portion of the weight of the inclined steel sheet is taken up by supporting the lower edge surface of said sheet, it is suitable, and in certain instances necessary, to support said edge surface along at least a substantial portion of its length, for the purpose of avoiding pressure on said lower edge surface of such magnitudes as to deform the same. For example, excessive pressure on said edge surface can be avoided by supporting the same via a support member which is arranged to extend along at least a substantial portion of the length of the edge surface and which accompanies the steel sheet during its movement through the furnace.

Further features of the invention will be apparent from the following description, made with reference to the accompanying drawing. In the drawing:

FIG. 1 illustrates an exemplary embodiment of a furnace for carrying out the method of the present invention seen in the direction of the arrow A in FIG. 2, and means for feeding steel sheets to the furnace and removing heated or heat-treated steel sheets therefrom, a portion of the furnace being shown in section to illustrate the construction of the furnace more clearly, although certain longitudinal sections of the furnace and the feed and discharged means have been excluded from the Figure, since they are unessential to obtaining an understanding of the invention;

Figure 1:
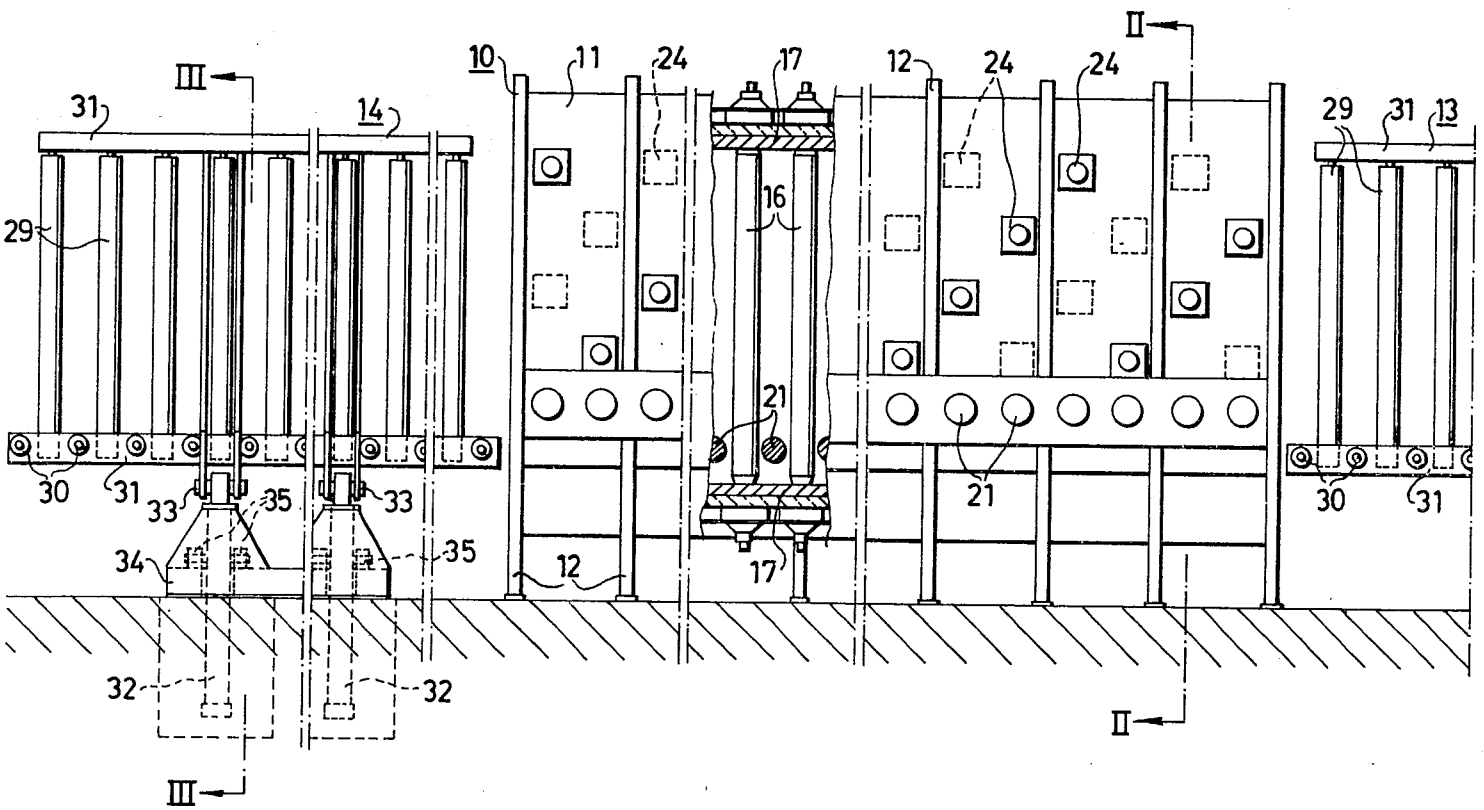

Like elements have been identified with like reference numerals in the different Figures, and the reference numeral 10 indicates a horizontally extending furnace comprising a furnace body 11 having an outer sheet metal shell lined with a refractory material, and further comprising frame members 12 carrying and supporting the furnace body 11. Co-operating with the ends of the furnace are means 13 and 14 for charging thereto steel sheets to be heated or heat treated in the furnace and for removing heated or heat-treated steel sheets therefrom (15, FIG. 3). The ends of the furnace are capable of being closed by means of furnace ports or gates not shown.

Figure 2:
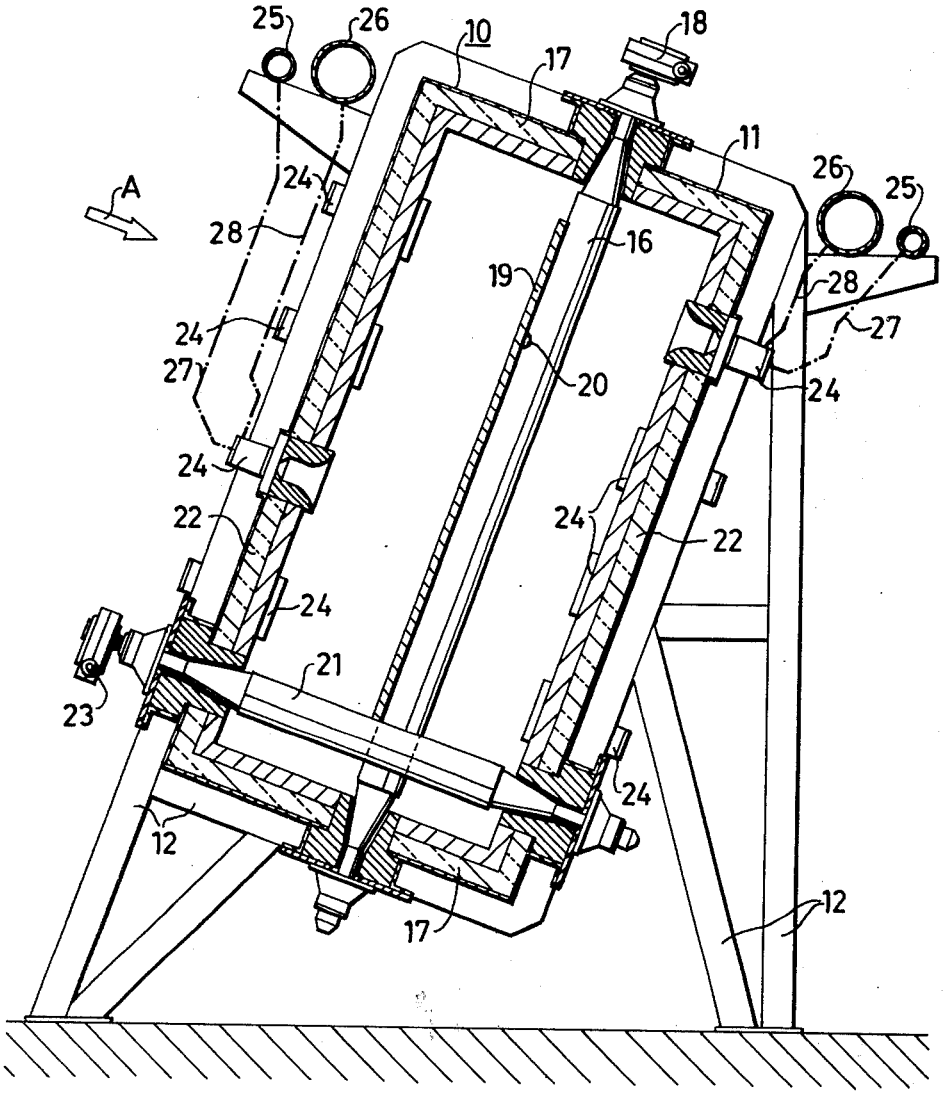
FIG. 2 is a sectional view taken through the line II—II in FIG. 1.

The furnace 10 is provided with a roller path comprising rollers 16. The rollers 16 are journalled in a suitable manner in two opposing furnace walls 17 and at least some of the rollers are driven as indicated by the worm gear 18 in FIG 2, to enable a steel sheet 19 being heated or subjected to heat-treatment in the furnace to be transported therethrough. One flat surface 20 of the steel sheet 19 abuts the rollers 16, the cylindrical surfaces of which engaging the side 20 of the steel sheet 19 thus form surfaces for supporting the side 20. For the purpose of reducing the pressure exerted by the steel sheet on the rollers 16, and thereby preventing the agglomeration of scale or other foreign material on the cylindrical surface of the rollers 16, such agglomerations being liable to cause recesses in the sheet surface 20 and possibly also to adhere thereto, the roller path is inclined to the vertical and transverse to the furnace so that only a portion of the weight of the sheet 19 is supported thereby, the remaining portion of the weight of the steel sheet being taken up by a roller path comprising rollers 21 and supporting the lower edge surface of the steel sheet 19.

The rollers 21 extend substantially at right angles to the rollers 16 and are journalled in a suitable manner in the furnace walls 22 extending parallel with the last mentioned rollers. It is an advantage if one or more of the rollers 21 are driven, as indicated by the worm gear 23 in FIG. 2.

Arranged in the furnace walls 22 is a number of heating means 24, which act on the flat side 20 of the metal sheet 19 between the rollers 16 and also on the opposing flat side 25 of said sheet, whereby the steel sheet 19 is rapidly heated throughout its whole thickness, so that the time during which the plate must be held in the furnace 10 is relatively short. The heating means 24, which in the exemplary embodiment are in the form of burners, are supplied with fuel from two supply pipes 25 carried on respective sides of the furnace and common for the burners on either side of the furnace. The same arrangement is applied for the supply of combustion air, the common air supply pipes being indicated by the reference numeral 26. The chain lines 27 and 28 indicate distributing pipes passing from the pipes 25 and 26 respectively to two of the burners 24.

It is also possible to replace the rollers 21 with radially outwadly projecting flanges located at the lower ends of the rollers 16 and arranged to support the lower edge surface of the steel sheet 19.

Should the pressure on the lower edge surface of the steel sheet 19 be of such magnitude when using the rollers 21 that the lower edge surface tends to become deformed, it is an advantage to mount between the steel sheet and the rollers 21 a support member which extends along a substantial portion of the edge surface of the steel sheet and which accompanies the steel sheet 19 during its movement through the furnace, whereafter the support member can be used to cushion a new steel sheet. Alternatively, the path formed by the rollers 21 can be replaced with another type of conveyor or movable supporting means, arranged to support the lower edge surface of the sheet along a considerable portion of its length in a manner to reduce the pressure on said edge surface to an acceptable magnitude.

Figure 3:
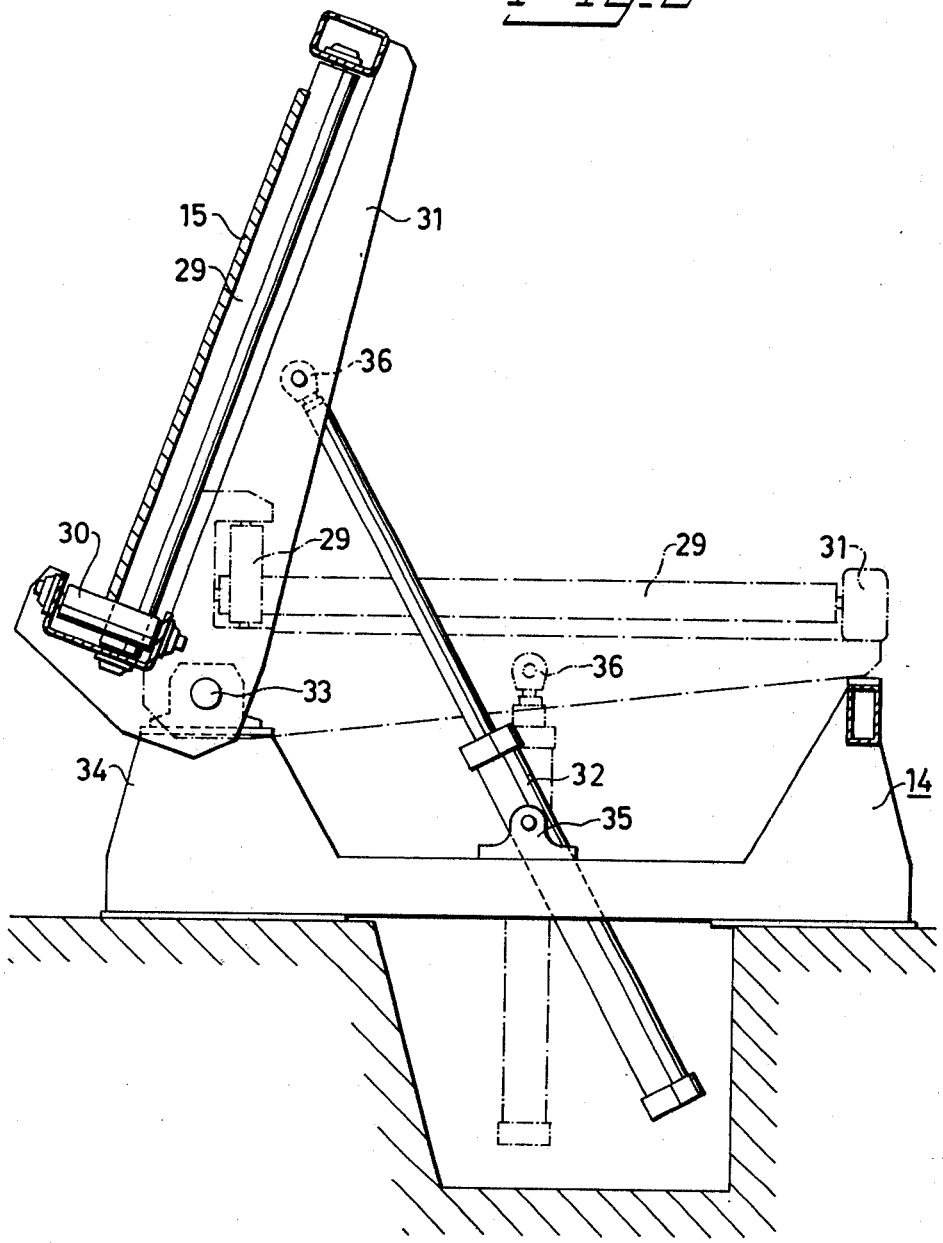
FIG. 3 is a sectional view taken through the line III—III in FIG. 1.

If the steel sheets to be heated or subjected to heat-treatment or having been heated or subjected to heat-treatment are conveyed to and from the furnace in a conventional manner lying in a horizontal position, means of the type indicated in FIGS. 1 and 3 by the reference numerals 13, 14 can be used to receive the steel sheets to be heated or heat-treated from a horizontal conveyor and to lift the sheets and feed them to the furnace, and to receive the steel sheets as they leave the furnace and to swing them down to a horizontal position and feed said heated or heat-treated steel sheets to a horizontal conveyor. The means 13, 14, which in the illustrated embodiment are of identical construction, each comprise two roller paths formed by rollers 29 and 30. The roller paths form a right angle to each other, and the rollers 29, 30 are journalled in a frame structure 31, capable of being pivoted by means of hydraulic cylinders 32 between a position illustrated in chain lines in FIG. 3, in which the roller path formed by the rollers 29 is horizontal, and an inclined position in which the roller paths formed by the rollers 29 and 30 lie in register with the roller paths formed by the rollers 16 and 21 in the furnace 10. The frame structure 31 is journalled at 33 in a frame 34, which via bearings 35 supports the cylinders 32, the piston rods of which are pivotally connected with the frame structure 31, as indicated at 36 in FIG. 3.

The invention is not restricted to the described and illustrated embodiment thereof. Thus, in addition to the aforementioned possible modifications concerning the arrangement for supporting the steel sheet when conveying the sheet through the furnace, many other modifications are conceivable within the scope of the following claims. For example, the concept of the invention can be applied with a furnace which is charged and emptied at one and the same side thereof, heating means of a type different to those illustrated can be used, and means can be provided for changing the angle of inclination of the support rollers or, optionally, of the furnace as a whole.

I claim:

1. A method of counteracting or preventing formation and agglomeration of scale and other foreign material on the roller surfaces of a roller path for supporting one flat side of a heavy steel sheet during heat treatment of said sheet in a furnace, comprising the steps of: transporting the steel sheet endwise in a substantially horizontal direction in said furnace; disposing and supporting said one flat side of the sheet by said roller path in a plane inclined with respect to the vertical and transverse to the furnace, during the entire heat treatment, to sustain only part of the weight of the inclined sheet; supporting the inclined sheet along the lower edge thereof by further sheet-supporting means, substantially at right angles to the roller path, during the entire heat treatment, to sustain the rest of the weight of the inclined sheet; selecting the angle of inclination of the sheet to the vertical so that the actual steel sheet thickness, expressed in millimeters, multiplied by the sine value of said angle of inclination is at most 12 to 15 millimeters to thereby restrict the pressure exerted by the inclined sheet perpendicularly against the rollers of the roller path to a value insufficient to cause the agglomeration of scale on said one flat side of the sheet and said rollers; and applying simultaneously with the described steps a heat treatment to the inclined steel sheet by exposing both said one flat side and the opposite flat side of the sheet between the rollers of the roller path to heat, to shorten the stay time of the sheet in the furnace.

2. A method as defined in claim 1, comprising the step of supporting the lower edge of the steel sheet along at least a considerable portion of its length.

3. A method as defined in claim 2, wherein the step of supporting the lower edge of the steel sheet is performed via an intermediate member extending along at least a considerable portion of the length of said edge of the sheet and accompanying the supported sheet during its passage through the furnace.

4. A method as defined in claim 1, comprising the step of changing the angle of inclination in which the steel sheet is supported.

* * * * *